US005435542A

United States Patent [19]

Van Pham et al.

[11] Patent Number: 5,435,542

[45] Date of Patent: Jul. 25, 1995

[54] STATEMENT PRESENTER MECHANISM FOR AUTOMATED TELLER MACHINE

[75] Inventors: Tuyen Van Pham, Massilon; Kevin Henderson, Dalton; Thomas S. Mason, Canton, all of Ohio

[73] Assignee: Interbold, North Canton, Ohio

[21] Appl. No.: 213,413

[22] Filed: Mar. 15, 1994

[51] Int. Cl.[6] ..... B65H 9/04

[52] U.S. Cl. ..... 271/246; 271/268; 271/273; 271/277; 271/265.01; 271/902

[58] Field of Search ..... 271/228, 246, 268, 272, 271/273, 277, 265, 902; 414/789; 198/434, 463.4; 221/21

[56] References Cited

U.S. PATENT DOCUMENTS

| | | | |
|---|---|---|---|
| 2,984,482 | 5/1961 | Kist et al. | 271/246 X |
| 3,716,228 | 2/1973 | Bottcher | 271/246 |
| 4,073,391 | 2/1978 | O'Brien et al. | 271/246 X |
| 4,078,790 | 3/1978 | Stocker | 271/246 X |
| 4,750,853 | 6/1988 | Van Soest et al. | 271/246 X |
| 5,203,504 | 7/1993 | Schmaling | 271/246 |
| 5,253,861 | 10/1993 | Schmaling | 271/245 X |
| 5,255,906 | 10/1993 | Ballard et al. | 271/246 |

FOREIGN PATENT DOCUMENTS

| | | | |
|---|---|---|---|
| 0244834 | 10/1987 | Japan | 271/245 |
| 0037066 | 2/1988 | Japan | 271/272 |
| 0056356 | 2/1990 | Japan | 271/273 |
| 0056357 | 2/1990 | Japan | 271/273 |
| 0211140 | 9/1991 | Japan | 271/273 |

*Primary Examiner*—H. Grant Skaggs
*Assistant Examiner*—Carol L. Oruzbick
*Attorney, Agent, or Firm*—Ralph E. Jocke

[57] ABSTRACT

A statement presenter for an automated teller machine includes a pair of upper belts (30) and a pair of lower belts (32). A paper stop (28) is mounted on a frame assembly (40). Cooperating arm members (42, 52) are operable to move the upper belts downwardly as the paper stop is moved upwardly and vice versa. In operation, the upper belts are moved upwardly while said paper stop is moved downwardly and a stack of papers (12) is accumulated. After accumulation of the stack, the paper stop is moved upwardly as the upper belt moves downwardly to engage the stack. Thereafter, the stack is moved outward to an exit slot (32) where the stack may be taken by a customer. If the customer fails to take the stack the direction of the belts is reversed until the stack engages a diverter plate (36) and passes into a storage bin (39) wherein the stack is held within the automated teller machine.

43 Claims, 12 Drawing Sheets

STATEMENT PRESENTER MECHANISM FOR AUTOMATED TELLER MACHINE

TECHNICAL FIELD

The present invention relates to a statement presenter mechanism which is particularly useful in an automated teller machine (ATM). Specifically, the apparatus of the present invention is directed to a simple, yet reliable, mechanism for presenting any one of a number of different sized bank statements, receipts or other documents which are presented individually or in stacks. In the event a customer fails to take the statements after they have been presented, the apparatus may retract the statements back into the automated teller machine and deposit it in a storage bin or other container.

BACKGROUND ART

Automated teller machines are known in the prior art. Banking customers may access their accounts using a magnetically encoded card. Generally the customer will insert their card into the machine, which will correlate the identifying information encoded on the card with a personal identification number provided by the customer. This verifies the customer's identity to the computer system which operates the machine. Thereafter the customer may typically use the ATM to conduct banking transactions as well as to check the status of various accounts that they have with the financial institution. When all of the transactions and inquiries are completed, the customer will receive his card back from the machine along with one or more receipts documenting the transactions performed.

As more people conduct their banking transactions electronically using ATMs, there is a desire to provide the customer with more information. Customers often want information about their accounts, including what checks have cleared and/or what other deductions and/or charges may have been applied. Customers may also wish to obtain information about other services provided by the bank such as investments, retirement accounts or the terms available for various types of loans.

It is usually not possible to print much information on a receipt that is provided by an ATM. This is because such receipts are typically fairly small in size. To provide all the information that customers want in a legible format, larger sheets are needed. In addition, information about some accounts, such as checking accounts, may be so extensive that even if large sheets are provided, multiple sheets will be required. The customer may wish to receive their entire checking account statement for the month or perhaps several months from the automated teller machine. Most ATMs that are presently in use are not capable of printing or delivering the type of sheets that are necessary for providing detailed customer statements nor are existing ATMs capable of delivering stacks of multiple statement sheets.

Further adding to the difficulty associated with providing detailed statement information from ATMs is that different institutions often desire to print different types of statements. These statements have different physical dimensions. As a result, any mechanism that is made for stacking and delivering statements to a customer from an ATM would have to be made to suit the particular size of statement that the bank wanted to deliver. This increases complexity and cost.

Another problem with statements presented by ATMs is that a customer who has conducted a banking transaction will often forget to take their receipt, or perhaps does not want the receipt. If so, the receipt will generally remain protruding from the face of the machine and sometimes the next person to use the machine will pull out the old receipt and throw it away. Passersby or other users will also look at the receipt out of curiosity. If the receipt contains confidential information regarding accounts, such as checking accounts, this could present undesirable security risks.

Regardless of whether the document contains confidential information, an untaken receipt becomes a nuisance and a potential source of litter. This is undesirable as it will tend to clutter the area of the automated teller machine making it unattractive and undesirable for customers.

Thus, there exists a need for an apparatus and method that enables a customer to receive a plurality of statements detailing the status of different accounts and transactions from an ATM and which avoids disclosure of the information and minimizes litter in the event the customer fails to take their statements.

DISCLOSURE OF INVENTION

It is an object of the present invention to provide an apparatus that stacks documents and delivers the stack to a customer using an ATM.

It is a further object of the present invention to provide an apparatus that can easily be modified to handle documents of different sizes.

It is a further object of the present invention to provide an apparatus for retracting a stack of documents and storing them in the event that a customer fails to take the documents within a predetermined time.

It is a further object of the present invention to provide an apparatus that can be operated to deliver documents to a customer either in stacks or one at a time.

It is a further object of the present invention to provide an apparatus that verifies that the documents entering the apparatus have been cut to the proper length.

It is a further object of the present invention to provide an apparatus for delivering statements to a customer using an ATM that is both reliable and low in cost.

It is a further object of the present invention to provide an ATM that presents stacks of various sized documents to a customer.

It is a further object of the present invention to provide a method for stacking and presenting documents to a customer using an ATM.

Further objects of the present invention will be made apparent in the following Best Modes for Carrying Out Invention and the appended claims.

The foregoing objects are accomplished in the preferred embodiment of the invention by a statement presenter apparatus incorporated into an ATM. The apparatus receives statements that have been printed on paper that has been taken from a storage bin within the machine and passed to a printer for printing information related to a customer's transactions or accounts. The innovative statement paper presenter apparatus of the present invention receives the documents and stacks them. The stack is presented to the customer by the apparatus. If the documents are not taken by the customer within a predetermined time, they are then returned through the apparatus and held within the machine.

The preferred embodiment of the invention places the papers to be delivered to the customer on to a lower conveyor belt which moves the papers and stacks them. The papers are stacked substantially flush against the paper stop. Once the printing of statements has been completed and all of the documents collected against the stop, the paper stop will preferably move upward while an upper belt moves downward. The paper is then moved by frictional engagement between the upper and lower belts by cooperative movement of the belts.

In the preferred embodiment, a sensor enables the belt to push a portion of the stack of papers through an exit slot in the fascia of the automated teller machine. After a predetermined time, if the papers have not been removed by the customer from the machine, the belts operate in the reverse direction and move the papers back into the machine. This rearward movement of the papers eventually causes them to engage a diverter plate and be routed into a storage bin.

BEST MODES FOR CARRYING OUT INVENTION

Figure 1:
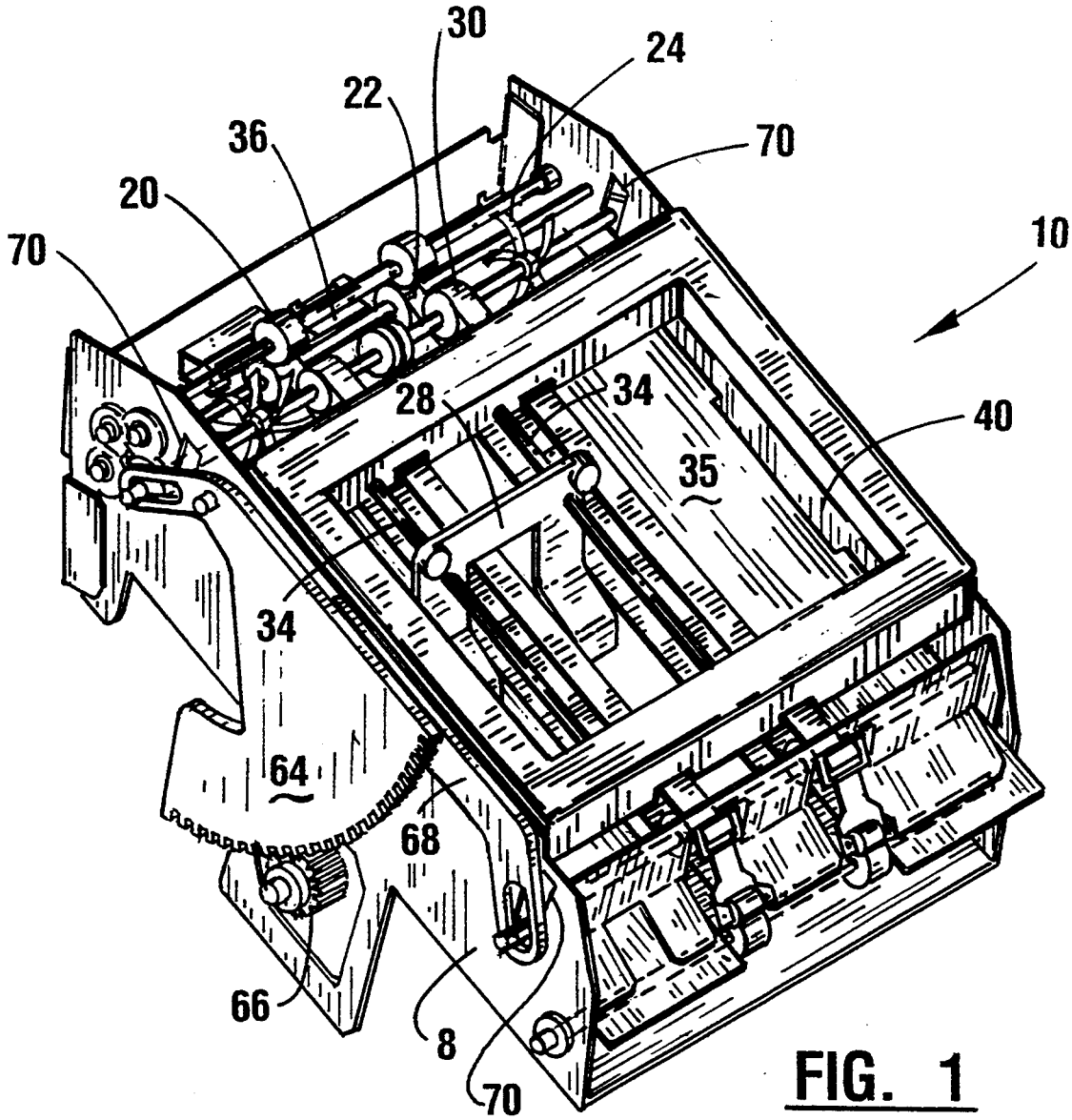
FIG. 1 is a perspective view of a preferred embodiment of the present invention.

Referring now to the drawings and particularly to FIG. 1, there is shown therein the preferred embodiment of the invention generally indicated 10. The preferred embodiment of the invention receives paper that has been pulled from a storage bin within an automated teller machine by rollers or a comparable mechanism associated with a printer. The printer prints information desired by a customer on the paper. The paper is either pre-cut or is preferably cut to size by a mechanism associated with the printer. After the paper exits the printer, it is received by the statement presenter of the present invention which either delivers the papers to the customer, or if a customer fails to take the statements, retracts them into the machine where they are stored until removed by a technician.

The preferred form of the statement presenter of the present invention is shown in FIG. 1. For simplicity, the main paper path is further illustrated by the partially sectioned side views in FIGS. 2, 3, 5, 6 and 7.

Figure 2:
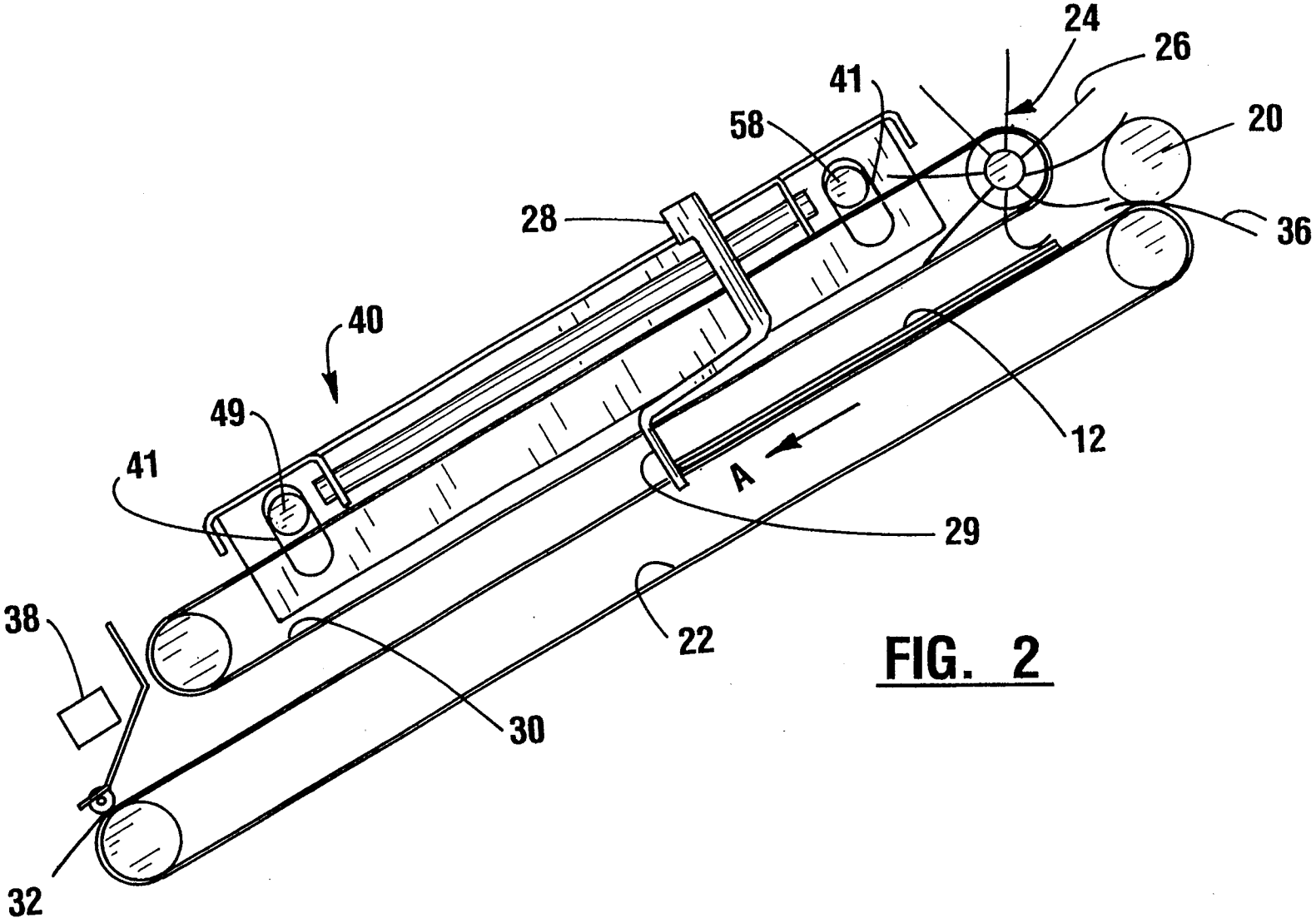
FIG. 2 is a sectioned partial side view of a portion of the statement presenter apparatus of the preferred embodiment shown in FIG. 1 wherein the paper stop is in the downward position and the upper belt is in an upward position.
Figure 5:
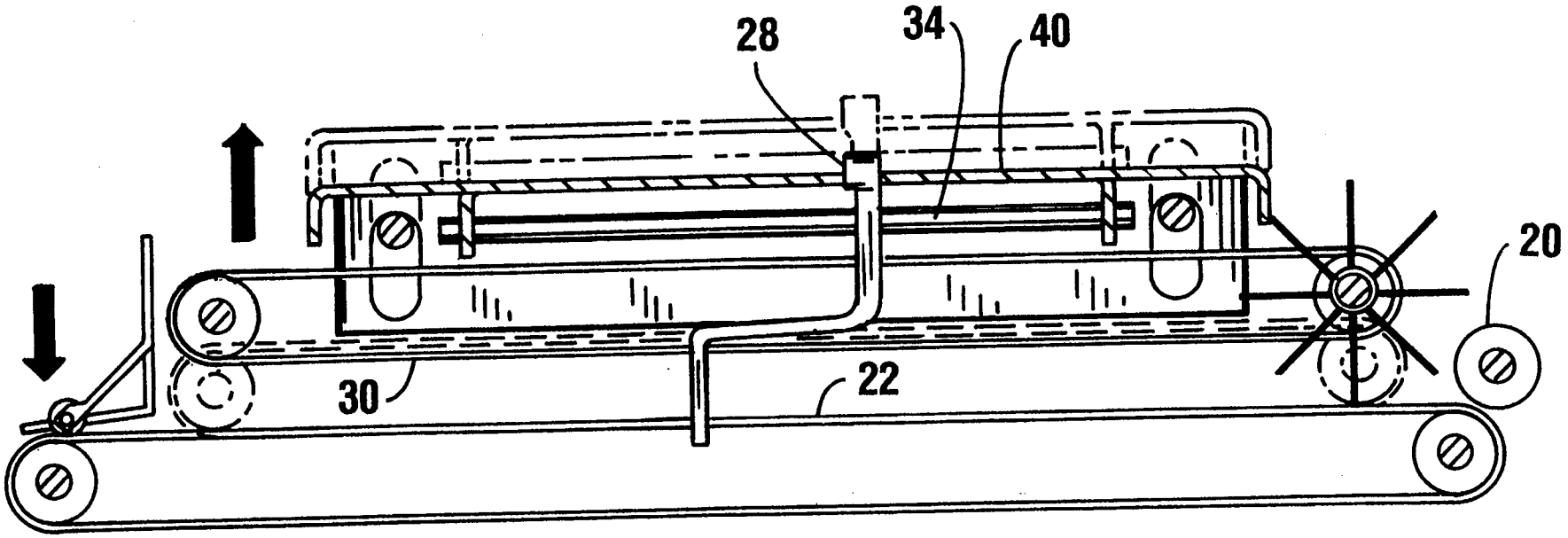
FIG. 5 is a partial sectional side view which corresponds to FIG. 2 showing the paper stop in the downward position with the upward position thereof shown in phantom.

As shown in the FIGS. 2 and 5, a statement paper 12 which has exited a printer mechanism and has been cut to length, is pulled by a set of rollers 20 which ride on lower belts 22. The rollers pull the paper into the apparatus. As the paper begins to exit the rollers, a flapper mechanism 24 provides rotational contact against the paper using flexible arms 26. The flexible arms 26 urge the paper to continue its movement away from the rollers and to continue into contact with the moving lower belt which moves in the direction of arrow A as shown in FIG. 2. As later explained, upper belts 30 move in coordination with the lower belts and further help to guide the paper into position.

The paper moves on the lower belts until the leading edge of the paper abuttingly contacts a paper stop 28. The paper stop 28 has fingers 29 that extend transversely downward between the lower belts. Generally, the lower belts will continue moving for a few moments after the paper has engaged the fingers of the stop thereby assuring that the paper has reached the stop. Once this has occurred, the belts will stop until the next paper, if any, arrives from the printer. A motor 27 (see FIGS. 9 and 10) drives the belts of the present invention in a manner later discussed in detail.

A sensor 37 monitors the paper entering the apparatus. The sensor 37 which is, preferably a photo eye or similar device, is used to assure that the paper has been properly cut. The sensor also controls the movement of the lower belts. Thus, when the sensor senses paper coming into the paper presenter, the lower belts are driven to carry the paper forward to the paper stop. Likewise, once the sensor determines that the trailing end of the paper has passed the sensor, the lower belts run for an additional time deemed necessary to carry the paper to the paper stop and then the lower belts are turned off. This is done under the control or a processor schematically indicated 17 which is appropriately programmed to drive the lower belts in accordance with the signals received from the sensor. If the sensor does not detect the trailing edge of the paper within a time calculated by the processor, it is known that the paper has not been cut, or there is another problem. The processor then generates a signal indicating a fault condition and further operation of the mechanism is avoided.

In an alternative embodiment employing the principles of the present invention, an automated mechanism can be connected to the sensor 37 wherein the sensor enables the processor to calculate the length of the paper entering the paper presenter and the mechanism adjusts the paper stop to accommodate the particular paper size. However, because in most embodiments only a single size of paper will be presented at one time, a manually adjustable paper stop is used in the preferred embodiment.

Paper stop 28 is preferably comprised of relatively hard and resilient material. It is adjustable and can be slid along guide supports 34 and 34' to accommodate different lengths of paper. The resilient character of the paper stop provides for holding the stop on the supports once it has been placed in the desired position. Preferably the paper stop is positioned so that the end of the paper is able to exit rollers 20 and be held in place by the action of the arms of the flapper mechanism 24. If the paper stop is set too far forward, the papers will not be in proper position for the flapper mechanism to work properly and may not allow the paper to pass from the rollers 20, resulting in paper jams.

Additional papers that come from the printer pass on top of the stack of papers supported on the lower belts of the mechanism in similar fashion. The flapper mechanism substantially prevents paper jamming and will generally cause the papers to become neatly stacked one on top of the other. A platen 35 which extends on the sides of the lower belts further helps to support the stack. Once all of the desired papers have been printed and stacked upon the lower belts with their edges against the paper stop, a signal is sent by the processor. This signal controls a drive mechanism which causes the paper stop to move upwardly away from the paper.

Figure 3:
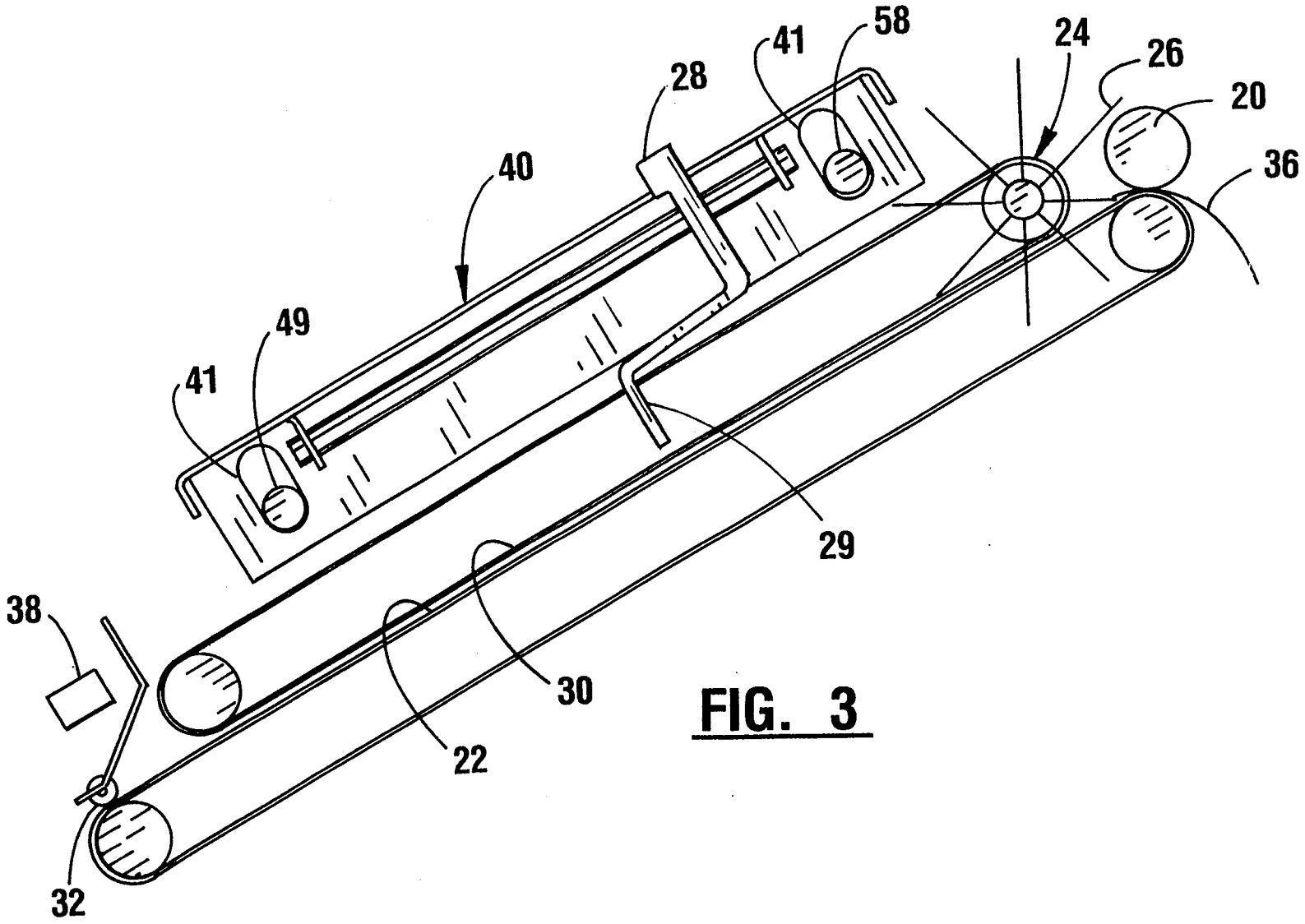
FIG. 3 is a sectioned partial side view of a portion of the statement presenter apparatus wherein the paper stop is in an upward position and the upper belt is in a downward position.
Figure 6:
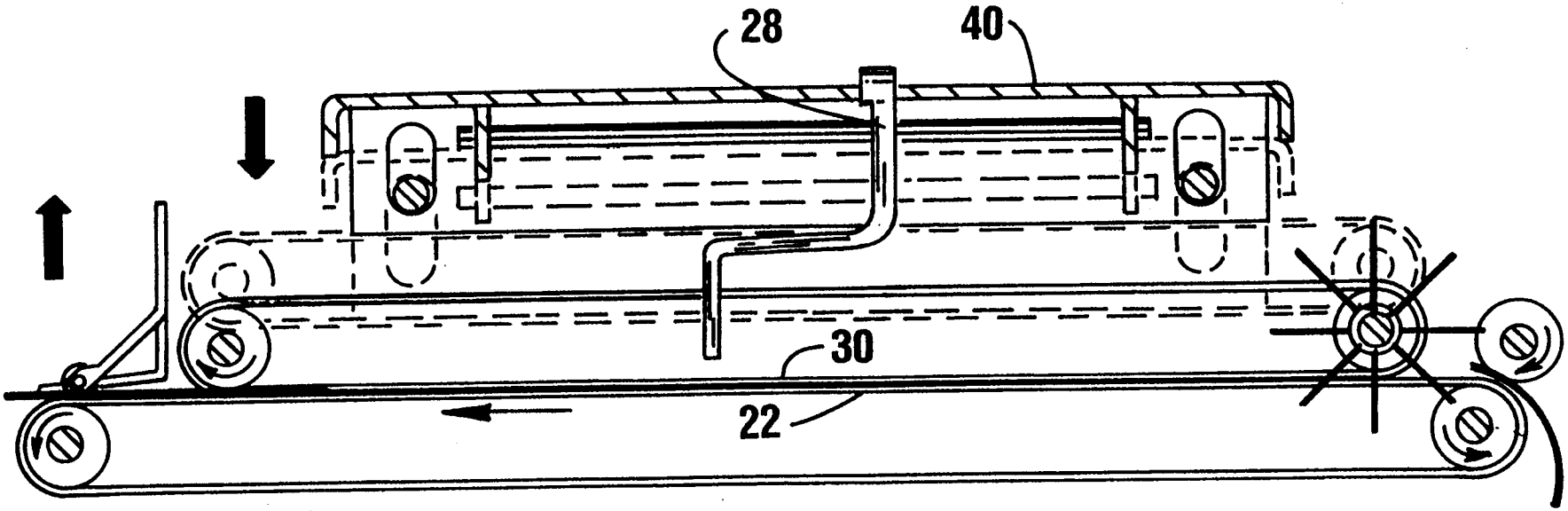
FIG. 6 is a partial sectional side view corresponding to FIG. 3 and showing the paper stop in the upward position and the upper belt moved downward to deliver statements to a customer.
Figure 7:
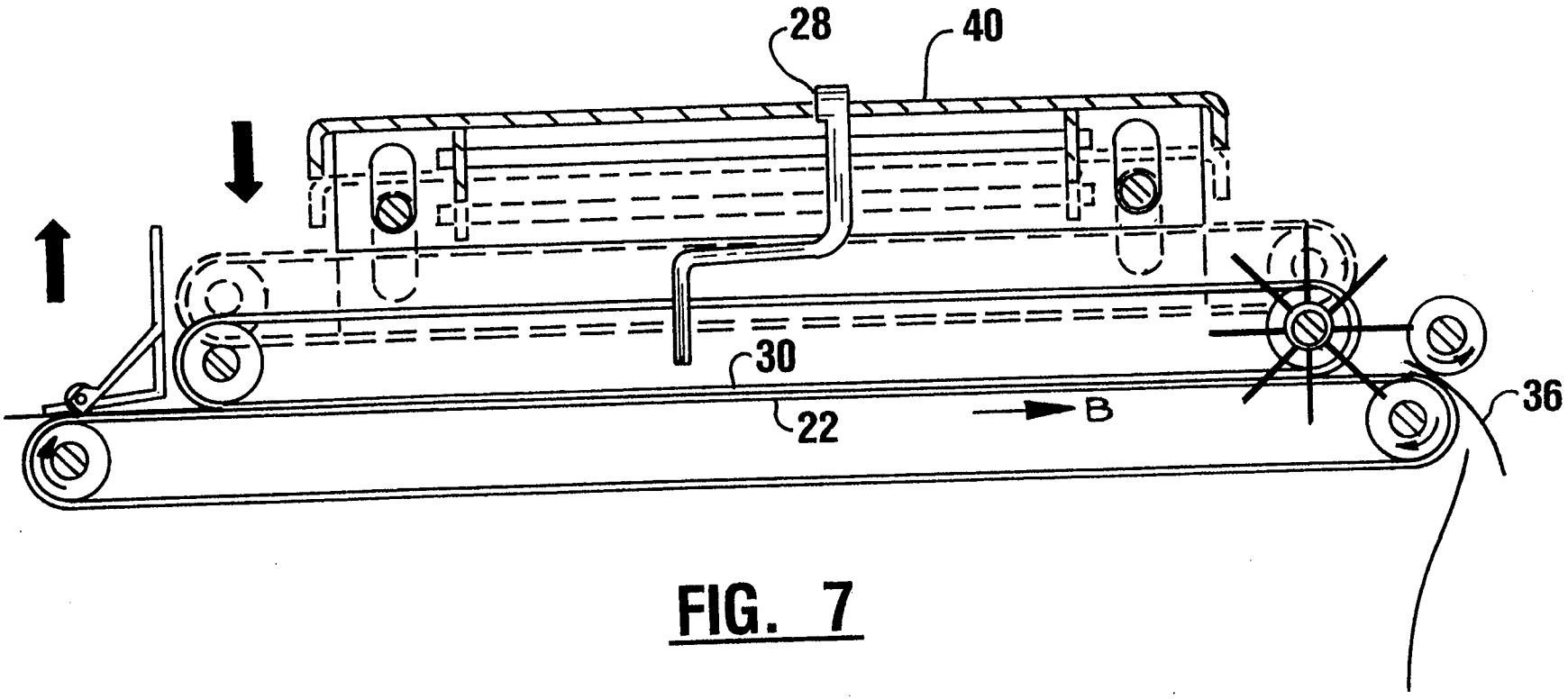
FIG. 7 is a view corresponding to FIG. 6 and showing statements that have been retracted by the apparatus.

The paper stop is moved on a paper stop frame assembly 40 upon which are mounted the guide supports 34 and 34'. As illustrated in FIGS. 3 and 6, as the paper stop moves upwardly away from the stack, an upper belt assembly simultaneously moves down and engages the top of the paper (or the top paper in the stack of papers). The top and bottom belts are then started and move at the same speed in substantial cooperation to move the stack outward to an exit slot 32.

Figure 4:
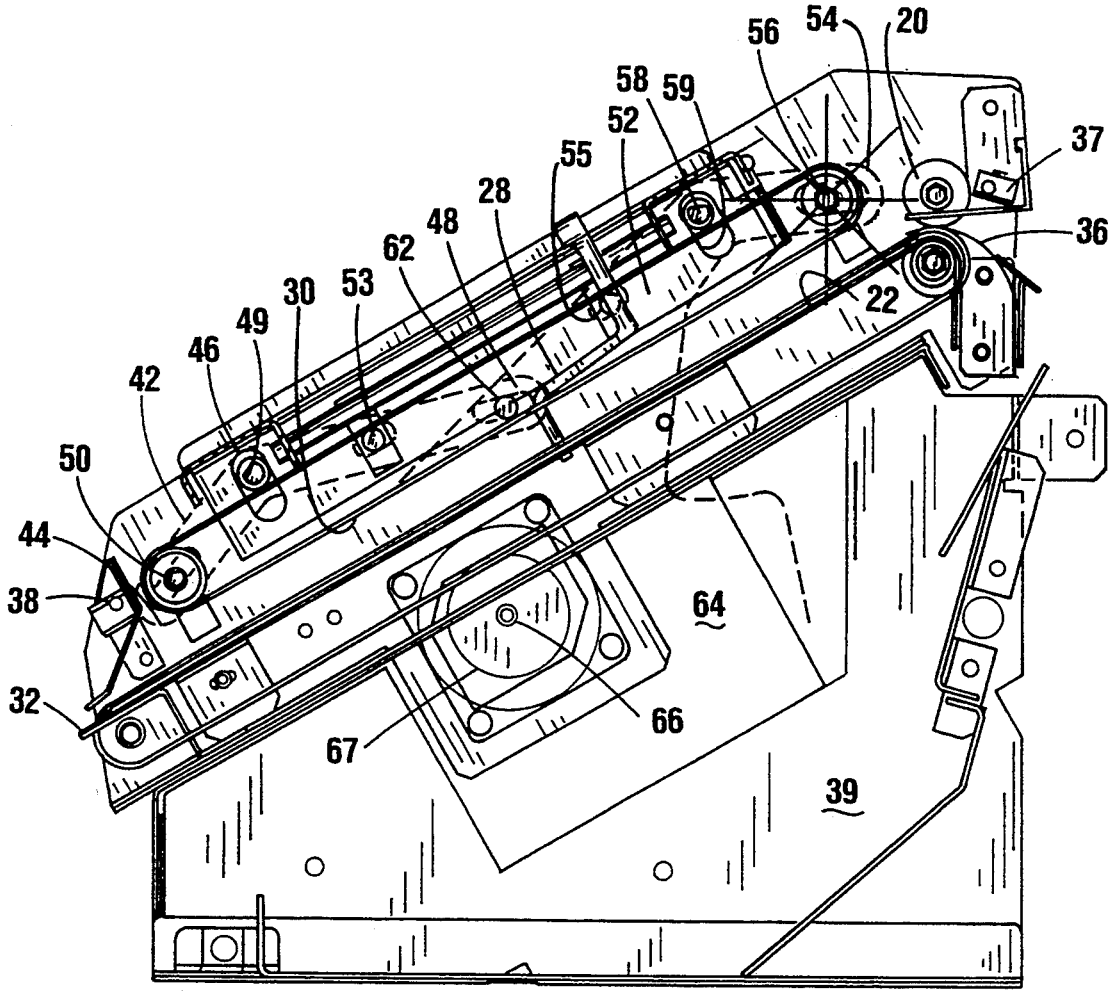
FIG. 4 is a transparent side view of the preferred embodiment of FIG. 1 and further illustrates the mechanism for moving the paper stop upwardly while moving the upper belt downwardly and vice versa.
Figure 8:
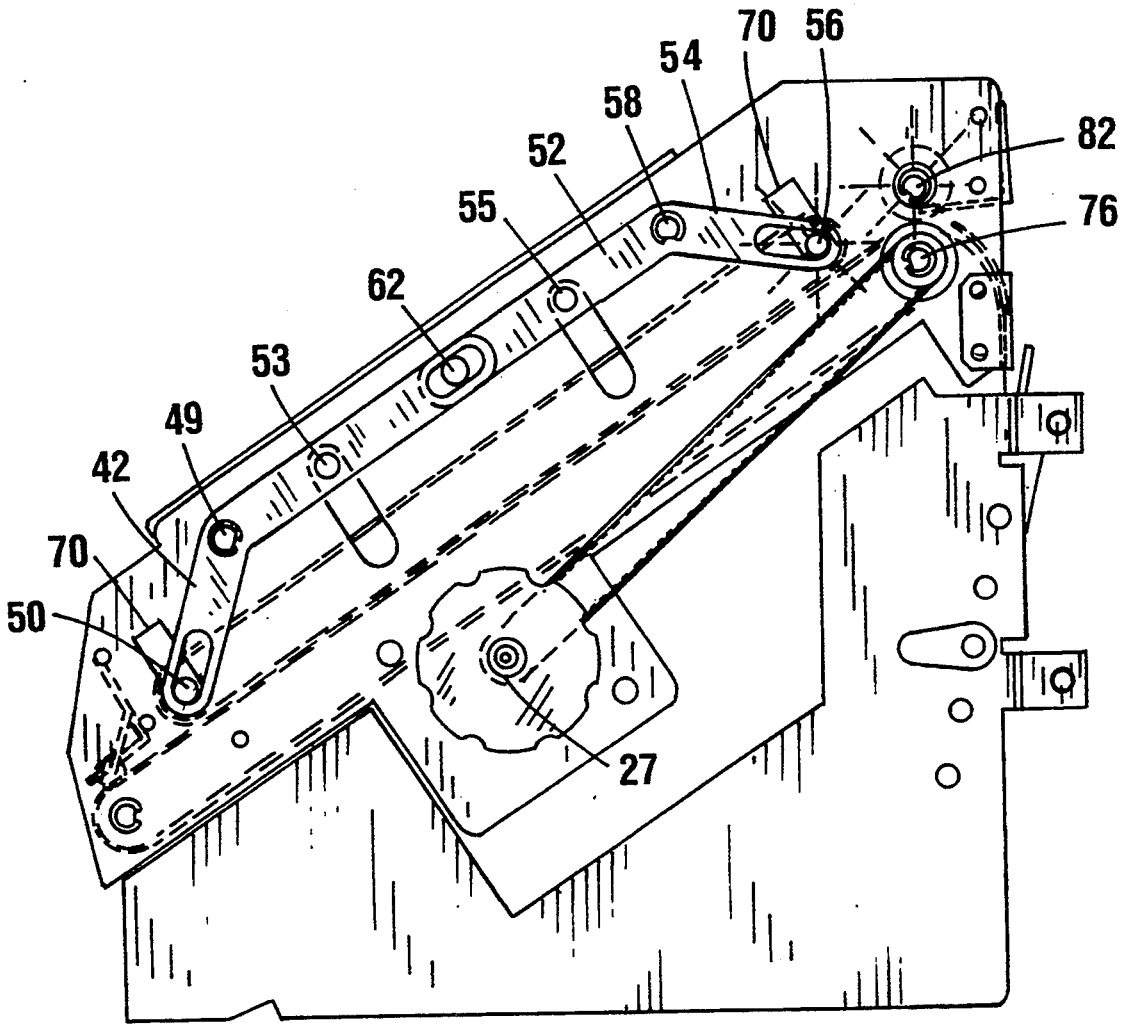
FIG. 8 is a right side view of the apparatus shown with the mechanism moved to position with the paper stop in an upward position.
Figure 9:
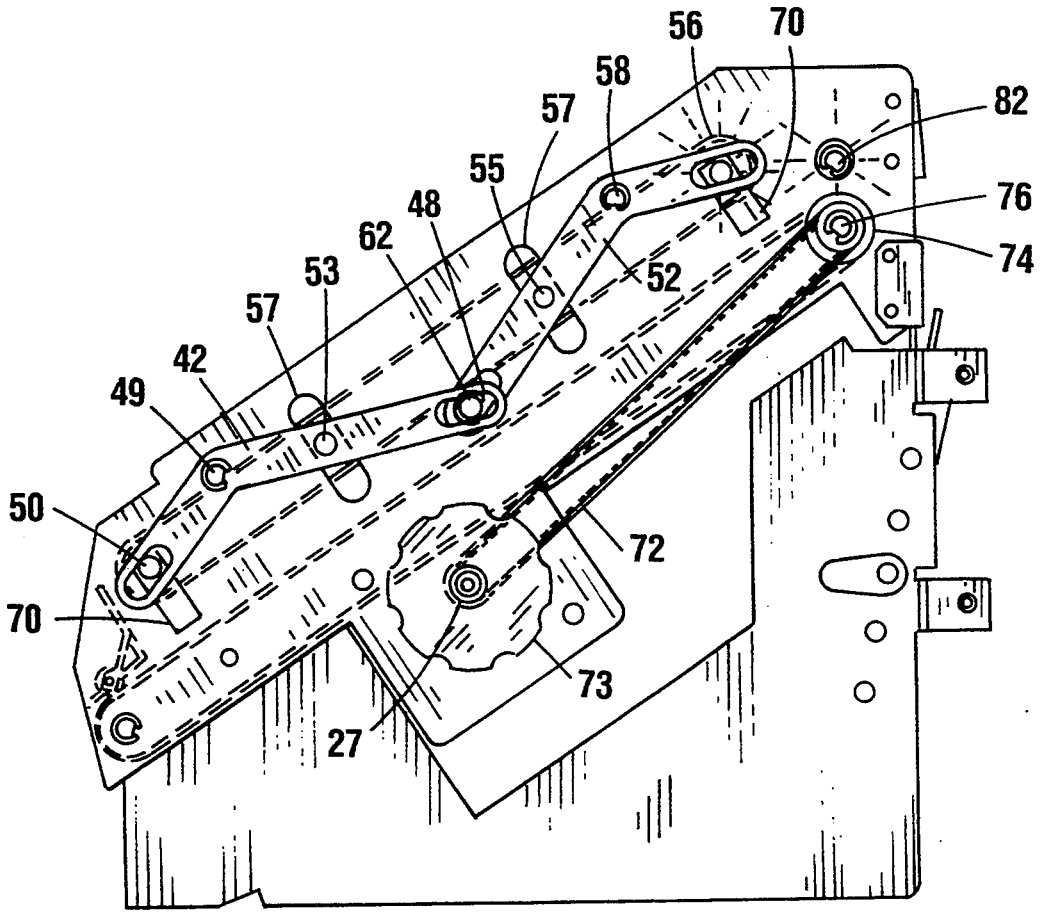
FIG. 9 is a right side view of the apparatus with the mechanism positioned so that the paper stop is in the downward position.

FIGS. 4 and 8 through 11 further illustrate the mechanism which raises the paper stop 28 while lowering the upper belts 30 (and vice versa). As best shown in FIGS. 4, 8 and 9, a rigid dog-leg shaped arm 42 has a slotted rear portion 44 in which is journalled a back axle 50 of the upper drive belts. A middle pivot point of arm 42 is movable about a fixed shaft 49. The fixed shaft 49 extends across the entire housing and is preferably secured at each end to the housing 8 as shown in FIG. 1. Arm 42 further includes a slotted front portion 48 which accepts a connector pin 62. Pin 62 extends from a front arm 52, and connects arm 42 thereto.

The back arm 42 and front arm 52 are interconnected to the paper stop 28 via connector pins 53 and 55 which are attached to the paper stop frame assembly 40. The connector pins 53 and 55 are enabled to move vertically in slots 57 which extend through the walls of the housing.

Similarly, the front arm 52 has a forward portion 54 in which a front axle 56 of the upper belts 30 is journalled. Front arm 52 pivots about a fixed shaft 58 which is preferably fixed to housing 8 and extends across the entire housing in a manner similar to shaft 49 (see FIGS. 1, 8 and 9).

The forward portion of back arm 42 overlaps with the rearward portion of the front arm 52. This overlapping section of contains the pin 62 which provides a pivoting connection. Arm 42 is preferably slotted so as to enable the movement of pin 62 therein. Hence, as pin 62 moves upwardly, the paper stop 28 moves upwardly due to the resulting upward movement of pins 53 and 55. Simultaneously, the front and rear axles 56 and 50 of the upper belts move downward due to the rotation of the arms about shafts 49 and 58. The axles 56 and 50 of the upper belts are enabled to move in the housing 8 in vertical slots 70 as shown in FIGS. 1, 8 and 9.

The frame assembly 40 also has slots 41 in the walls thereof. As shown in FIGS. 2 and 3, the shafts 58 and 49 which extend across the housing extend through slots 41 and enable the frame assembly to move thereon in guided relation.

Figure 10:
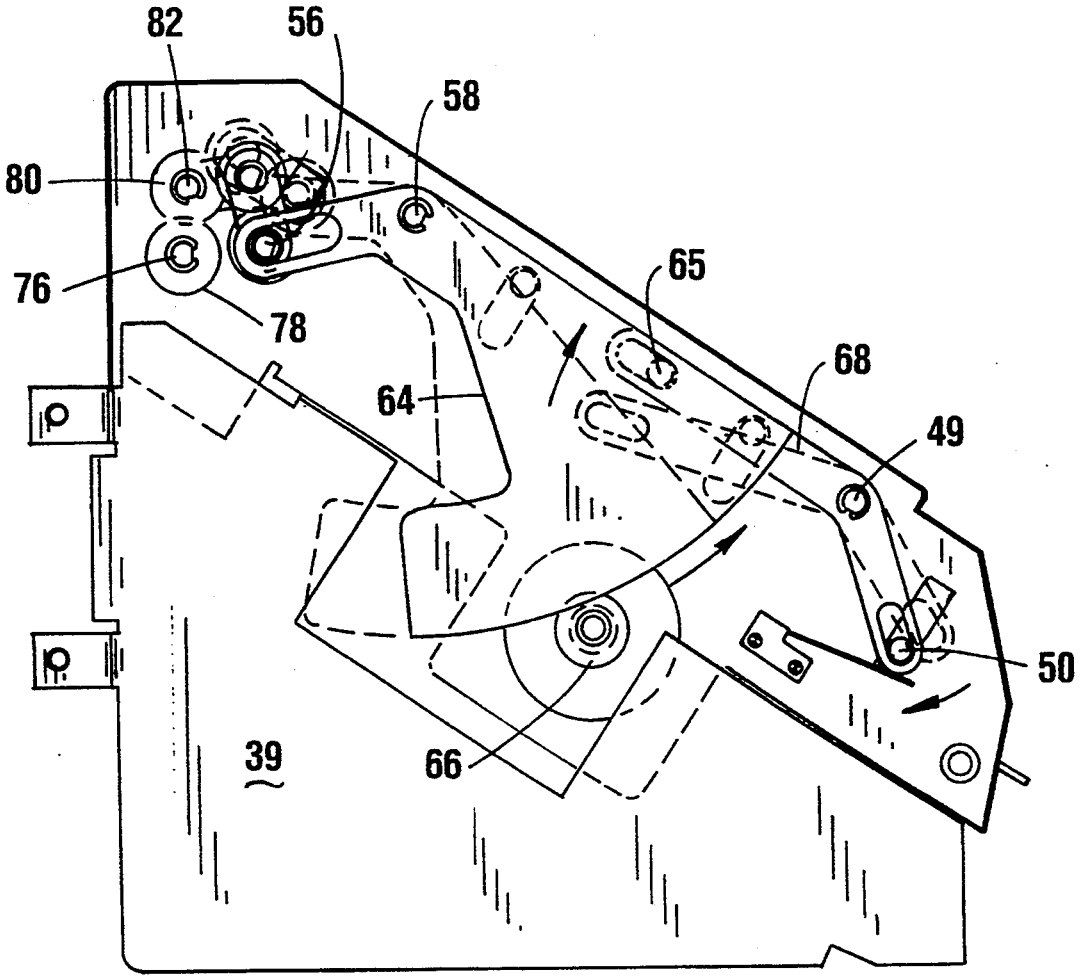
FIG. 10 is a left side view of the apparatus showing the position of the mechanism with the paper stop in the upward position, and the alternative position shown in phantom.
Figure 11:
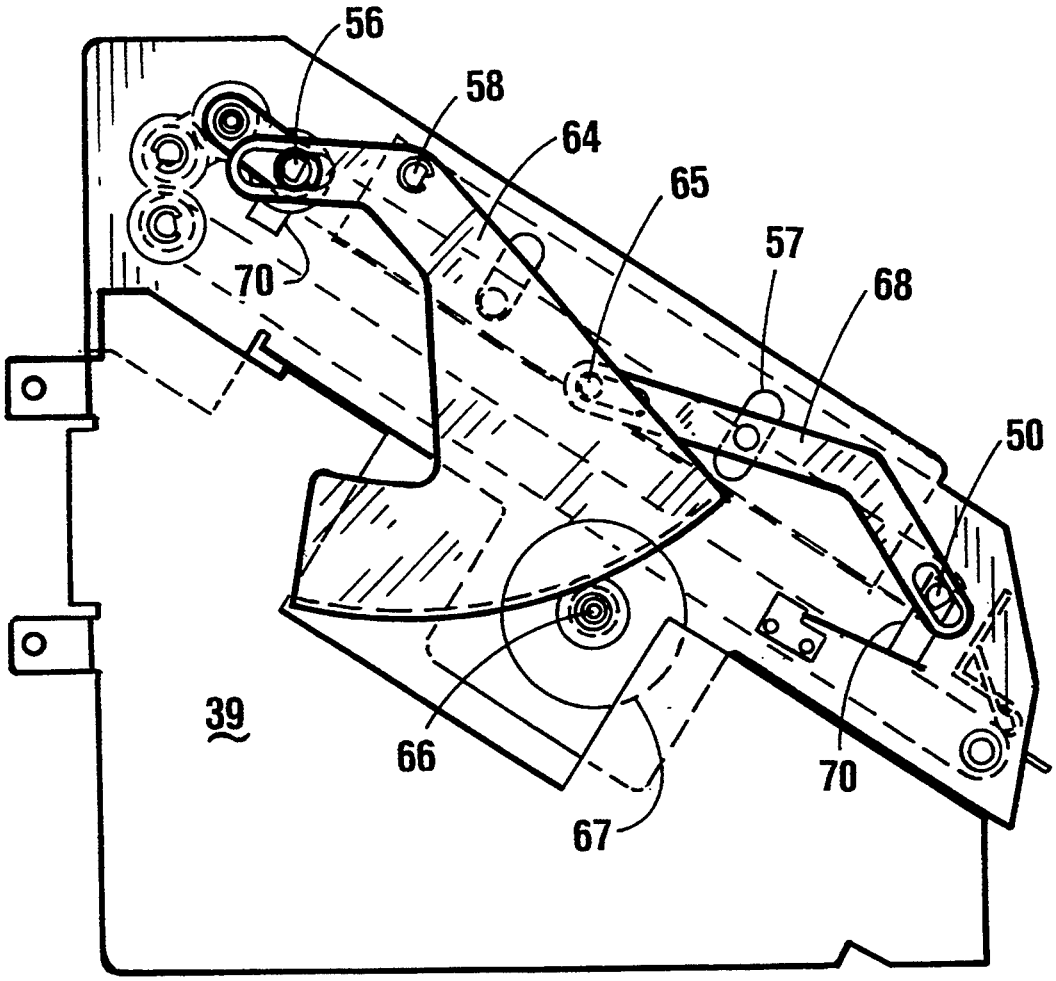
FIG. 11 is a left side view of the apparatus with the mechanism shown with the paper stop in a downward position.

The upward and downward movement of the paper stop and upper belt assembly is controlled by a rack and pinion gear train which is best shown in FIGS. 1, 10 and 11. A gear member 64 is positioned on the left side of the housing. The gear member is preferably integrally formed with a front arm having a forward portion similar in shape to arm 52 previously discussed. The gear teeth on the gear member 64 engage a pinion 66. As the pinion rotates clockwise as shown in FIGS. 10 and 11, the gear member rotates counter clockwise, raising the paper stop and lowering the upper belt. Conversely, as the pinion moves counterclockwise, the gear member moves clockwise, lowering the paper stop and raising the upper belt. Hence, the paper stop and the upper belt are interconnected in a way that causes each to move in the opposite direction. This is controlled by the direction and amount of rotation of the pinion.

The pinion 66 is driven by a drive motor 67 which is positioned opposite motor 27 on the frame. Further, as shown in FIGS. 10 and 11, a rear arm 68 which is a mirror image of arm 42 is positioned on the left side of the housing and engages a pin 65 on the gear member in a slotted fashion similar to arm 42.

Figure 12:
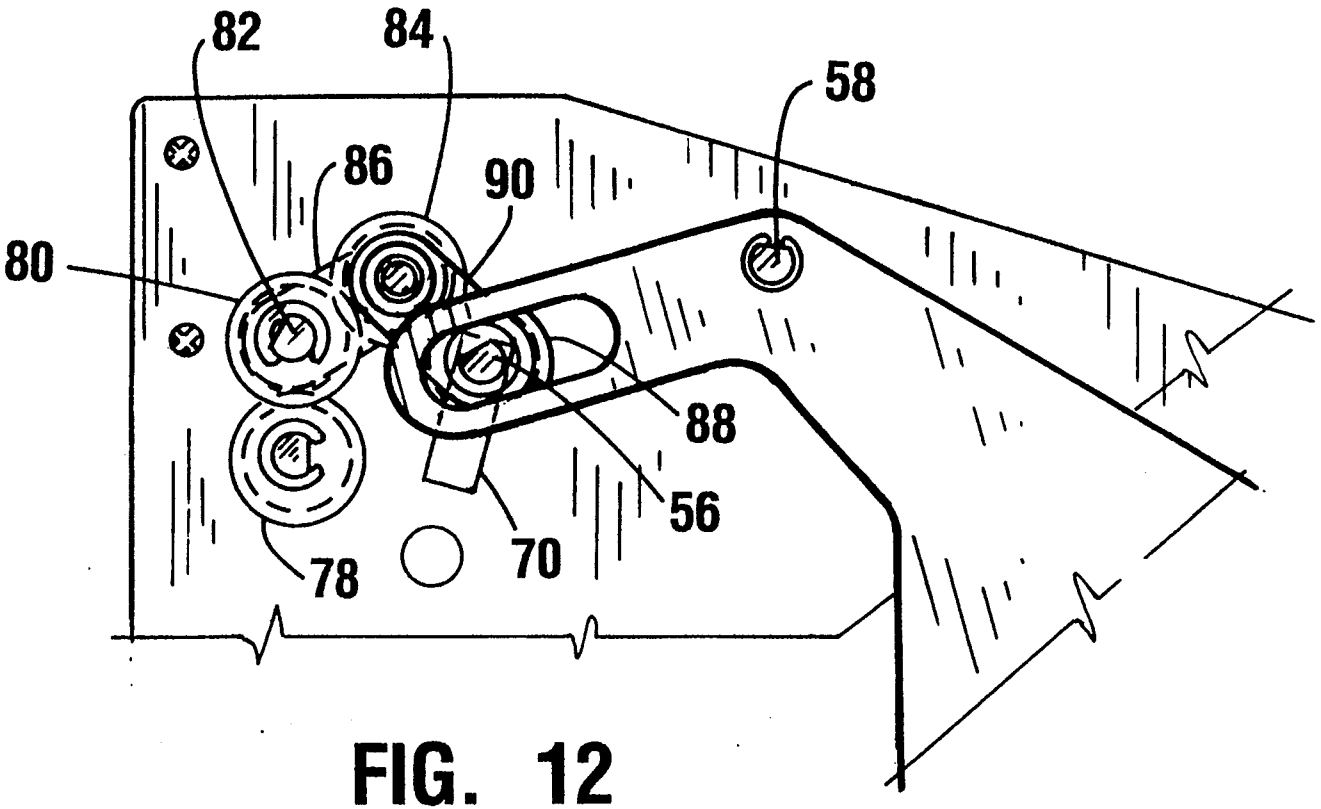
FIG. 12 is a left side view of the mechanism showing the gear train for driving the upper belts of the apparatus.

The drive mechanism for the belts is best shown with reference to FIGS. 9, 10 and 12. As shown in FIG. 9, motor 27 drives a belt 72 which in turn drives a pulley 74. The shaft of motor 27 also has a hand wheel 73 attached thereto which facilitates manual rotation of the motor. This is useful in clearing paper jams. Pulley 74 is connected to a shaft 76 which drives the lower belts. Shaft 76 extends through the housing to the left hand side as shown in FIGS. 10 and 12. Shaft 76 drives a gear 78 on the left hand side of the housing. Gear 78 is connected to a gear 80, which in turn drives a shaft 82. Rollers 20 are mounted on shaft 82 and are driven thereby.

Gear 80 drives another gear 84. Gear 84 is a floating gear which is mounted on a link 86 which is rotatably movable about shaft 82. Gear 84, in turn, drives another gear 88 which is mounted on a link 90. Link 90 is rotatable about the axis of gear 84. Gear 88 drives front axle 56 of the upper belt. As a result, axle 56 is enabled to move up and down in slot 70 while being continuously driven by motor 27. As will be understood by those skilled in the art, axles 56 and 50 may include appropriate bushings thereon so as to enable them to move up and down in slots 70 without sustaining significant frictional losses.

In operation, once the printed papers are collected against the paper stop 28, motor 67 operates to rotate gear member 64 counterclockwise. This raises the paper stop and lowers the upper belts. Motor 27 is then started so that the upper and lower belts cooperatively move the stack forward, thereby moving the stack of papers toward the exit slot 32.

An exit sensor 38, which is preferably a photo eye or similar device, senses when the front edge of the papers have passed through the exit slot. As the ATM is designed so that the papers in this position are extending through an opening in the machine and are accessible by the customer, the processor 17 which operates the machine causes motor 27 to turn off. Thereafter, motor 67 turns on so as to raise the upper belts. The customer is then free to remove the stack from the machine.

In the event that exit sensor 38 does not sense the removal of the stack within a pre-set time, the processor controlling the operation of the machine will cause motor 67 to operate, again lowering the upper belts. Motor 27 is then operated in the reverse direction so that the stack is drawn back between the belts and moved towards rollers 20 in the direction indicated by FIG. 7. As the stack approaches rollers 20, the stack a flexible engages diverter plate 36 Rollers 20 extend through cut outs in diverter plate 36 to engage belts 22. Diverter plate 36 guides the paper below the plate and into a storage bin 39 where the papers will be held until removed by a technician. Hence, when paper enters the presenter, the paper moves over the diverter plate and on to the lower belt. However, when the paper is moved in the opposite direction towards rollers 20, it engages the flexible diverter plate and passes below it so that it can be diverted into the bin.

Of course, in alternative embodiments of the invention, the paper may instead of being held, may be carried out of the bin by sets of rollers or by other mechanical means to a location where it may be periodically removed by a service technician. This insures that the customer's confidential account information is not available to unauthorized persons who might otherwise find it as litter near the ATM.

It should further be pointed out that while the presenter mechanism of the present invention is preferably operated so as to stack papers and then present the stack to the customer, it may alternatively be operated to present statements to a customer one at a time in the manner traditionally done by ATM machines.

In this mode of operation, the statement presenter is operated with the upper belts engaged with the lower belts. As a result, when a paper passes into the device from the printer, it is immediately carried between the belts to the exit end to be taken by the customer. Depending on the nature and speed at which the statements are received from the printer, it may be alternatively possible to selectively position the paper stop so that the papers are enabled to ride below the paper stop on the lower belt flights 22 without direct engagement with the upper belt flights 30. In this manner the papers are simply carried unobstructed in a one-at-a-time manner to the customer. This may be advantageous when the operation of the ATM involves the delivery of only a single document and where it is undesirable to take the time associated with raising and lowering the upper belt flights.

The statement presenter mechanism of the present invention may be readily adjusted to accommodate various paper sizes. The paper length may be changed by simply moving the paper stop 28 along the guide supports 34 and 34' to the desired position. Further, the mechanism is made so that the width of the paper may be varied substantially without modification of the mechanism. This results because of the wide clearance area through the device and the central location of the belts of the preferred embodiment. Any paper width which can be engaged by one or both of the belts and which can be abuttingly engaged with the paper stop may be delivered by the mechanism.

The preferred embodiment of the present invention enables the collection of a substantial number of statements in a stack which then can be transported in a compressed manner through an outlet slot in the facia of an ATM machine and delivered to a customer. The statement presenter of the present invention is reliable and avoids paper jams. It also avoids litter in the event that the customer fails to take their statements. Although the preferred form of apparatus of the present invention is used in presenting documents that have been printed within an automated teller machine, it may be alternatively used to accumulate documents such as currency notes, coupons, tickets, vouchers or other pre-printed documents and then to deliver them in a stack to a customer operating a dispensing device.

Although the embodiment of the invention shown has two upper belts and two lower belts, alternative embodiments may include additional belts journalled on the axles. Applicants have found that in some embodiments it is desirable to have a third upper belt positioned in centered relation between the other upper belts for moving the stack. The third belt may be positioned above a platen that extends between the lower belts. When the upper belts are lowered, the stack rides on the lower belt and the platen to either the exit slot or the diverter plate. Other embodiments may have other numbers and configurations of platens, belts or other driving means.

Thus, the new statement presenter of the present invention achieves the above stated objectives, eliminates difficulties encountered in the use of prior devices and systems, solves problems and attains the desirable results described herein.

In the foregoing description certain terms have been used for brevity, clarity and understanding, however no unnecessary limitations are to be implied therefrom because such terms are for descriptive purposes and are intended to be broadly construed. Moreover, the descriptions and illustrations given are by way of examples and the invention is not limited to the details shown and described.

Having described the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

I claim:

1. A paper presentation apparatus for an automated teller machine, comprising:

a movable first belt, a first axle and a second axle disposed from said first axle, said first belt supported on said first and second axles;

a movable second belt extending generally parallel of said first belt, a paper stop, and a mechanism interconnecting said paper stop and said first belt wherein as said paper stop is moved away from said second belt, said first belt is moved toward said second belt, and vice versa, said mechanism including a first arm member and a second arm member, said first arm member rotatable about a first pivot and said second arm member rotatable about a second pivot, and wherein said first axle is journalled in said first arm member on a first side of said first pivot and said paper stop is connected to said first arm member on an opposed side of said first pivot, and wherein said second axle is journalled in said second arm member on a first side of said second pivot and said paper stop is connected to said second arm member on an opposed side of said second pivot.

2. The apparatus according to claim 1 wherein said first and second arms are pivotally engaged intermediate of said first and second pivots.

3. The apparatus according to claim 2 wherein said apparatus includes a frame having first and second slots extending generally in a traverse direction of said belts, and wherein said first and second axles are movable in guided relation in said first and second slots respectively, and wherein said first and second arms include first and second arm slots respectively, said first and second axles journalled in said first and second arm slots respectively.

4. The apparatus according to claim 3 wherein said frame comprises a pair of spaced side walls, and wherein said apparatus comprises a pair of said first arm members and a pair of said second arm members, each of said arm members in a pair disposed on opposed sides of said spaced side walls, and wherein each side wall includes said first and second slots therein enabling movement of said first axle and said second axle therein respectively.

5. The apparatus according to claim 4 wherein one of said arm members includes a gear portion, and wherein said apparatus further comprises a pinion engaging said gear portion and a reversing motor for driving said pinion, and wherein said reversing motor moves said paper stop and first belt.

6. The apparatus according to claim 1 wherein said paper stop comprises at least one finger portion extending in a traverse direction of said belts, and wherein said finger portion extends traversely beyond said second belt when said paper stop as positioned adjacent said second belt.

7. The apparatus according to claim 6 and further comprising a platen having a platen surface extending adjacent and generally in a plane with said second belt, and wherein said finger portion of said paper stop extends traversely beyond said platen surface when said paper stop is positioned adjacent said second belt.

8. The apparatus according to claim 3 wherein said paper stop is mounted on a paper stop frame and wherein said paper stop frame is engaged to each of said arm members by connector pins.

9. The apparatus according to claim 8 wherein said apparatus comprises a frame having frame walls and wherein said frame walls include pin connector slots, wherein said connector pins extend from said arm members to said paper stop frame through said pin connector slots.

10. The apparatus according to claim 1 and further comprising an entry end, and an entry sensor sensing a sheet adjacent said entry end, and further comprising a paper entry timing device in operative connection with said entry sensor, wherein said entry end timing device generates a signal when said sheet is adjacent said entry sensor for more than an entry time.

11. The apparatus according to claim 1 and wherein said first axle is driven by a gear train, said gear train including a pair of floating gears.

12. The apparatus according to claim 11 wherein each floating gear is journalled on a link, each link rotatable about an adjacent gear.

13. The apparatus according to claim 1 and further comprising an entry end and an entry sensor adjacent said entry end sensing a sheet passing adjacent thereto, and wherein said apparatus further comprises a motor driving said belts to accept said sheet into said apparatus, and wherein said motor is operatively connected to said entry sensor wherein said entry sensor is operative to start said motor upon entry of said sheet into said entry end.

14. The apparatus according to claim 1 and further comprising an entry end and wherein a sheet enters said apparatus through said entry end and wherein said sheet travels in a generally first direction into said entry end, and wherein said second belt extends from said entry end in a direction downward relative to said first direction, whereby sheets are stacked above prior sheets against said paper stop.

15. The apparatus according to claim 14 wherein each said sheet has a leading edge engaging said paper stop and a trailing edge adjacent said entry end.

16. The apparatus according to claim 15 and further comprising a rotatable flapper adjacent said entry end, said flapper including arms deformably engagable with said sheets, whereby said sheets are urged into a stack adjacent said paper stop.

17. The apparatus according to claim 16 and further comprising a deformable diverter plate adjacent said entry end, whereby said sheets pass on a first side of said diverter plate as said sheets move in the first direction through said entry end, and wherein said diverter plate engages sheets passing in an opposed direction on a second side of said diverter plate whereby said diverter plate prevents said sheets from passing out of said entry end.

18. A paper presentation apparatus for an automated teller machine comprising:

a movable first belt, a movable second belt extending generally parallel of said first belt, a guide support extending generally parallel of said first belt, a paper stop wherein said paper stop is movably mounted on said guide support, said paper stop movable on said guide support in a direction generally parallel of said belts, a mechanism interconnecting said paper stop and said first belt wherein as said paper stop is moved away from said second belt, said first belt is moved toward said second belt, and vice versa.

19. A paper presentation apparatus for an automated teller machine comprising:

a movable first belt, a movable second belt extending generally parallel of said first belt, a paper stop, a mechanism interconnecting Said paper stop and said first belt wherein as said paper stop is moved away from said second belt, said first belt is moved toward said second belt and vice versa, and wherein said apparatus further comprises an entry end, and a diverter plate adjacent said entry end, wherein said diverter plate is adjacent said second belt and disposed in a direction away from said second belt and toward said first belt, and wherein paper sheets entering said apparatus through said entry end pass between said diverter plate and said first belt.

20. The apparatus according to claim 19 wherein said diverter plate is disposed from said second belt wherein sheets are enabled to pass between said diverter plate and said second belt.

21. The apparatus according to claim 19 and further comprising a storage bin positioned vertically below said diverter plate.

22. The apparatus according to claim 21 and further comprising a roller positioned adjacent said entry end, said roller in engagement with said first belt, and wherein said diverter plate includes a cut-out, and wherein said roller extends through said cut-out to engage said first belt.

23. The apparatus according to claim 22 wherein said diverter plate is flexible.

24. A paper presentation apparatus for an automated teller machine comprising:

a movable first belt, a movable second belt extending generally parallel of said first belt, a paper stop, a mechanism interconnecting said paper stop and said first belt wherein as said paper stop is moved away from said second belt, said first belt is moved toward said second belt, and vice versa, and wherein said apparatus further comprises an exit end, and an exit sensor adjacent said exit end sensing sheets at said exit end, and a first reversible motor in operative connection with at least one of said first and second belts, and a timing device in operative connection with said first motor and said exit sensor, wherein said first motor is operative to move said sheets in a first direction to said exit end wherein said sensor senses said sheets, and wherein if said sheets are sensed after a time determined by said timing device, said first motor is operative to move said sheets in a second direction away from said exit end.

25. The apparatus according to claim 24 and further comprising a second reversible motor in operative connection with said interconnecting mechanism, wherein said first belt is moved adjacent said second belt responsive to a first movement of said second reversible motor whereby said sheets move in said first direction between said belts, and wherein when said sheets reach said exit end, said first belt is disposed away from said second belt responsive to a second movement of said second motor, whereby said sheets may be removed from said exit end.

26. The apparatus according to claim 25 and wherein said second motor is operatively connected to said timing device, and wherein said belts are moved adjacent by said first movement of said second motor if said sheets are not removed within said time.

27. A paper presentation apparatus for an automated teller machine comprising:

a movable first belt, a movable second belt extending generally parallel of said first belt, wherein said second belt is supportably driven by a first shaft, a paper stop, a mechanism interconnecting said paper stop and said first belt wherein as said paper stop is moved away from said second belt, said first belt is moved toward said second belt, and vice versa, a roller adjacent and movable in cooperating relation with said first shaft, said roller supportably driven by a roller shaft, said roller shaft driven by said first shaft, said first belt supportably driven by an axle shaft, said axle shaft having a first gear thereon, said first gear engaged with a second gear, said first and second gears journalled on a first rotatable link, said second gear engaged with a third gear, said second gear and third gear journalled on a second rotatable link, said third gear operatively engaged with said roller shaft, whereby said first axle is movable in driven relation with said roller shaft.

28. A paper presentation apparatus for an automated teller machine comprising:

a movable first belt wherein said first belt is supported on a first axle, and wherein said first axle has a first flapper member mounted thereon, a movable second belt extending generally parallel of said first belt, a paper stop, and a mechanism interconnecting said paper stop and said first belt wherein as said paper stop is moved away from said second belt, said first belt is moved toward said second belt, and vice versa.

29. A paper presentation apparatus for an automated teller machine comprising:

a movable first belt, a movable second belt extending generally parallel of said first belt, a paper stop, a mechanism interconnecting said paper stop and said first belt wherein as said paper stop is moved away from said second belt, said first belt is moved toward said second belt, and vice versa, and wherein said apparatus further comprises an entry end and an entry sensor adjacent said entry end sensing a sheet passing adjacent thereto, and wherein said apparatus further comprises a motor driving said belts to accept said sheet into said apparatus, and wherein said motor is operatively connected to said entry sensor and wherein said entry sensor is operative to stop movement of said motor after said sheet has cleared said entry end.

30. The apparatus according to claim 29 and further comprising a timer operatively connected to said entry sensor, wherein said timer is operative to turn off said motor a time after said sheet passes said entry sensor.

31. A paper presentation apparatus for an automated teller machine comprising:

a first sheet movement means for moving sheets in contact therewith;

a second sheet movement means for moving sheets in contact therewith, said second sheet movement means movable between a first position adjacent said first sheet movement means and a second position disposed from said first sheet movement means;

a paper stop means for stopping sheets from passing between said first and second sheet movement means, said paper stop means movable between a stop position wherein it stops the passage of sheets and a disposed position wherein sheets are enabled to pass between said first and second sheet movement means;

first interconnecting means for interconnecting said second sheet movement means and said paper stop means, wherein when said paper stop means is in the stop position, said second sheet movement means is in the second position, and wherein when said paper stop means is in the disposed position, said second sheet movement is in the first position;

wherein said apparatus includes an entry end and an exit end, and further comprises means for holding said sheets at said exit end and means for returning said sheets from said exit end by passing them between said first and second sheet movement means toward said entry end.

32. The apparatus according to claim 31 and further comprising diverter means for diverting said sheets to a storage bin as said sheets are moved toward said entry end.

33. A method for presenting stacks of sheets to a customer from an apparatus in an automated banking machine, comprising the steps of:

moving sheets on a first belt in a first direction into a stack against a paper stop;

disposing said paper stop from said stack;

moving a second belt to engage said stack on an opposed side from said first belt; and moving said first and second belts in said first direction to move said stack to an exit end of said apparatus whereby said stack is delivered to a customer.

34. The method according to claim 33 and further comprising the step of disposing said second belt from said stack when said stack is at the exit end.

35. The method according to claim 33 and further comprising the steps of:

timing with a timing device a time that said stack is at said exit end; and moving said stack in an opposed direction between said belts if said stack is not removed during said time.

36. The method according to claim 34 and further comprising the steps of:

timing with a timing device a time said stack is at said exit end;

moving said second belt adjacent said stack if said stack is not removed during said time; and moving said belts in an opposed direction to move said stack from said exit end.

37. The method according to claim 33 and further comprising the step of passing sheets in said first direction one at a time onto said first belt by passing them on a first side of a diverter plate.

38. The method according to claim 37 and further comprising the step of moving said stack in an opposed direction and engaging said stack and said diverter plate wherein said stack is directed by said diverter plate to a second side of said diverter plate, and passing said stack into a storage bin.

39. The method according to claim 33 wherein said method further comprises passing said sheets in an entry direction one at a time between said first and second belts, and wherein said first direction is downward relative to said entry direction.

40. The method according to claim 39 and further comprising interconnecting said second belt and said paper stop with a mechanism and wherein when said paper stop is adjacent said stack, said second belt is disposed from said stack and vice-versa.

41. The method according to claim 40 wherein said interconnecting step comprises connecting said second belt and said paper stop with a mechanism that includes a pair of rotatable dog-leg shaped arm members, said dog-leg shaped arm members aligned relative to one another in said first direction, wherein each dog-leg shaped arm member rotates in a plane about spaced pivots, said dog-leg shaped arm members pivotally engaged to one another at first ends thereof, said second belt supported on spaced axles journalled in opposed ends of said dog-leg shaped arm members, and wherein said paper stop is connected to said arm members intermediate of said pivots.

42. The method according to claim 33 and further comprising the step of sensing a sheet entering an entry end of said apparatus with an entry sensor and stopping movement of said first belt after said sheet has passed through said entry end.

43. The method according to claim 42 and further comprising the steps of measuring a duration said sheet is sensed by said entry sensor with a timer and generating a fault signal if said duration exceeds a time.

* * * * *